United States Patent [19]

Immordino

[11] 4,032,101

[45] June 28, 1977

[54] CLAMPING-TYPE BRACKET

[75] Inventor: Vincent J. Immordino, Flushing, N.Y.

[73] Assignee: Display Originals, Inc., Flushing, N.Y.

[22] Filed: Mar. 31, 1976

[21] Appl. No.: 672,063

[52] U.S. Cl. ..... 248/225.4

[51] Int. Cl.[2] ..... A47J 3/14

[58] Field of Search ..... 248/226 E, 226 R, 188.2

[56] References Cited

UNITED STATES PATENTS

| | | | |
|---|---|---|---|
| 1,157,418 | 10/1915 | Polson et al. | 248/226 R X |
| 1,454,935 | 5/1923 | Lent | 248/126 |
| 2,819,037 | 1/1958 | Wilkin | 248/188.2 X |
| 3,030,730 | 4/1962 | Costar | 248/188.2 |
| 3,944,178 | 3/1976 | Greenwood | 248/226 D |
| 3,949,880 | 4/1976 | Fortunato | 248/226 A |

*Primary Examiner*—William H. Schultz

[57] ABSTRACT

A clamping type bracket which is attachable without tools to a shelf or other board-like members to support a shelf extension or other objects. The bracket includes an upper arm adapted to rest on the top surface of the shelf and a lower arm which extends below the undersurface of the shelf to define a free space therebetween, the lower arm being in the form of a ramp whose sloping surface is treaded. Receivable within the free space is a removable locking piece whose horizontal upper edge engages the undersurface of the shelf and whose lower edge is sloped and treaded to complement the ramp, whereby when the piece is thrust into the free space, it wedges therein to secure the bracket to the shelf.

5 Claims, 8 Drawing Figures

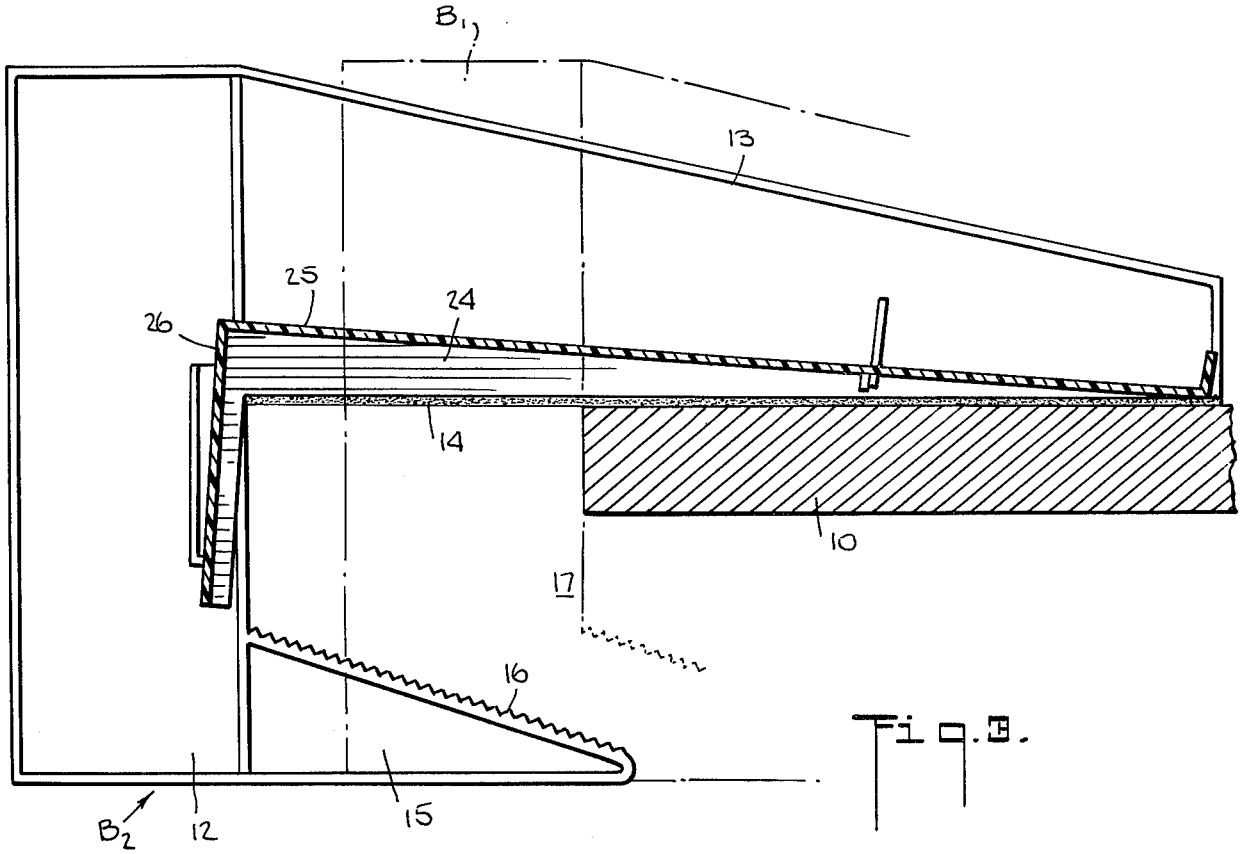
Fig. 3.
Fig. 4.
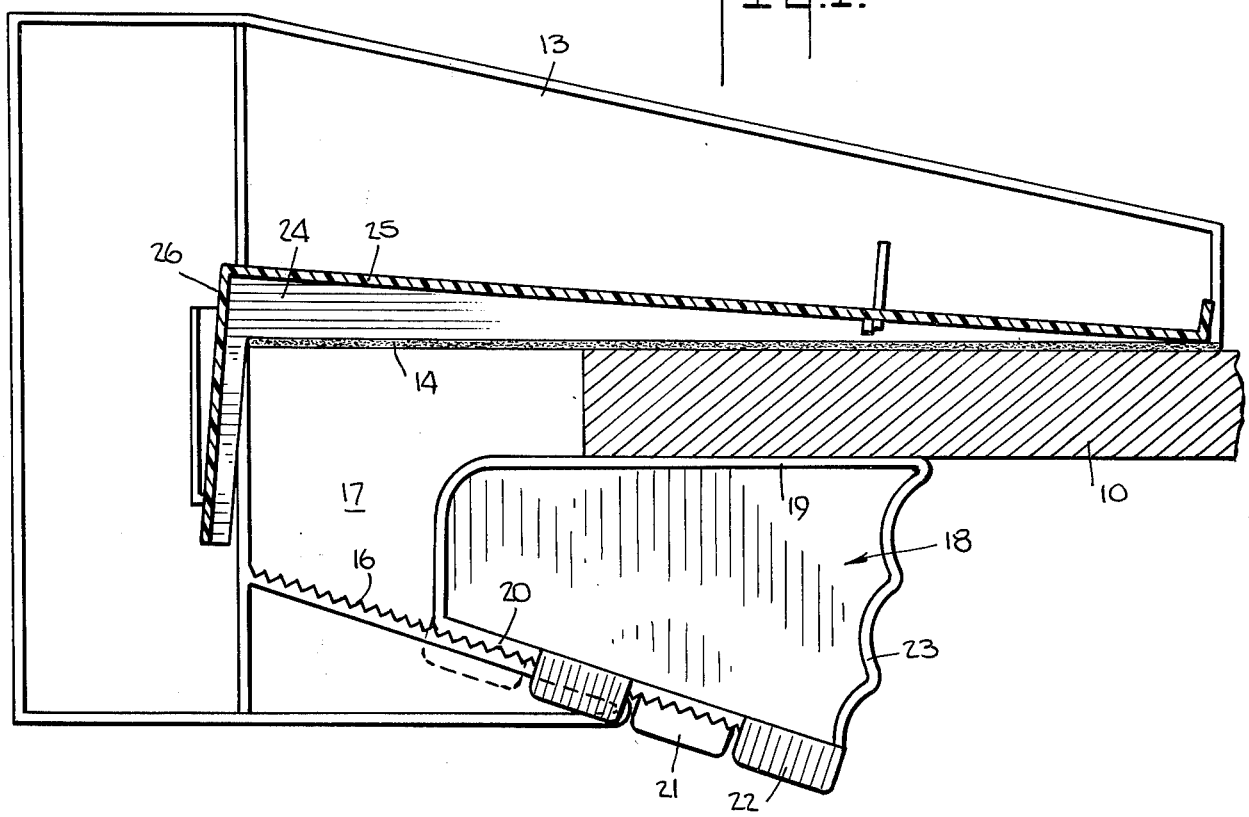

Fig. 5.
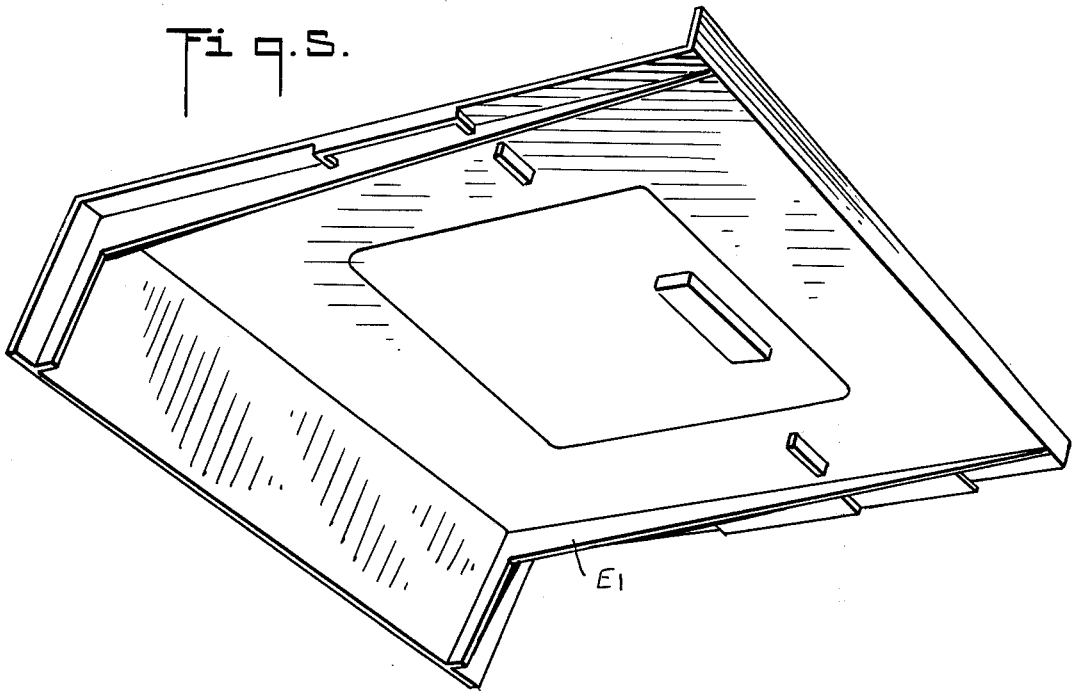
Fig. 7.
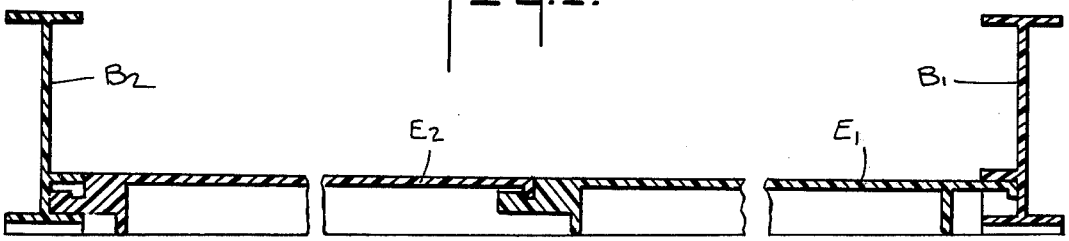
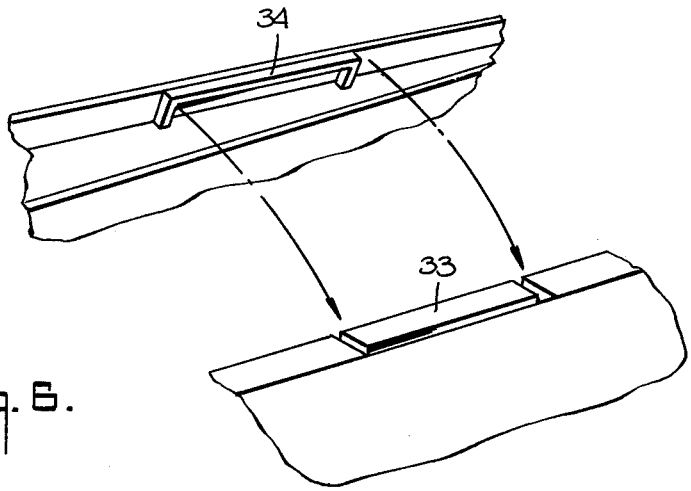
Fig. 6.

CLAMPING-TYPE BRACKET

BACKGROUND OF INVENTION

This invention relates generally to clamping-type brackets which are attachable to shelves or other board-like members to support extension shelves or other objects, and more particularly to a bracket which is installable without tools by means of a removable locking piece.

Clamping-type brackets are adapted to engage a shelf, a desk or table top, or other board-like members, the bracket being formed by an upper arm which rests on the shelf, and a lower arm which lies below the shelf. To secure the bracket to the shelf, the usual practice is to provide a threaded clamping bolt which passes vertically through a bore in the lower arm and terminates in an anchoring disc. By turning the bolt by means of a tool or handle, the disc is forced against the underside of the shelf to secure the bracket in place.

Since the conventional clamping-type bracket is intended for attachment to shelves or other board-like members, the spacing between the upper and lower arms is made sufficiently large to permit use of the bracket with boards in a range of thicknesses. Hence with a thin board, the clamping bolt must be turned almost all of the way in to engage the board, so that only a small section of the bolt projects below the lower arm, whereas with thicker boards the bolt is turned in to a lesser degree and more of it projects below the lower arm.

Apart from the fact that such clamping bolts are unsightly and therefore objectionable in those situations where the bolts are visible, the existing clamping arrangement has a number of other practical drawbacks. Since the bracket is anchored by means of a disk pressed by the bolt into the underside of the shelf or board, this disc tends to cut into the board and mar the finish thereof. Also, unless the disc is very tightly pressed into the board—and this requires a fair degree of strength—it acts as a pivot point, making it possible to swing the bracket thereabout. Such displacement of the bracket is undesirable.

SUMMARY OF INVENTION

In view of the foregoing, the main object of this invention is to provide a stable clamping bracket which can be securely installed without difficulty by means of a removable locking piece.

A significant feature of the invention is that the locking piece is interposed between the lower arm of the bracket and the undersurface of the shelf or other board to which it is attached, so that the clamping piece is normally not visible or aesthetically disturbing. An important advantage of the invention is that no tools or hardware are required to install the bracket.

More specifically, it is an object of this invention to provide a clamping bracket of simple and practical design, all of whose components may be molded at low cost of synthetic plastic material, without the need for machining or threading operations.

Yet another object of the invention is to provide a pair of clamping brackets which cooperate with a shelf-extension to form a shelf-extension assembly which is attachable to a standard shelf, making it possible to segregate and prominently display selected articles.

Briefly stated, these objects are attained in a bracket having an upright beam from whose upper end is laterally extended an upper arm adapted to rest without slippage on the top surface of a shelf or other board-like member, and from whose lower end is laterally extended a lower arm which lies below the undersurface of the shelf. The lower arm is constituted by a ramp whose sloping surface is treaded, preferably in a rack-like pattern, to define a converging free space between the sloping surface and the underside of the shelf.

Receivable in the free space is a removable locking piece whose horizontal upper edge engages the undersurface of the shelf and whose treaded lower edge is sloped to complement the ramp, whereby when the piece is thrust into the free space, it wedges therein to secure the bracket to the shelf.

OUTLINE OF DRAWING

For a better understanding of the invention as well as other objects and further features thereof, reference is made to the following detailed description to be read in conjunction with the accompanying drawings, wherein:

FIG. 3 is a sectional view of one of the brackets mounted on a shelf; the locking piece being omitted;

FIG. 4 is a sectional view that is the same as FIG. 3, save that the locking piece is wedged in place;

FIG. 5 is a perspective view of the underside of one section of the shelf extension;

FIG. 6 illustrates the manner in which the two shelf extension sections are interconnected;

FIG. 7 is a sectional view showing how the shelf extensions are supported between a pair of clamping brackets.

DESCRIPTION OF INVENTION

Referring now to FIGS. 1 to 7, there is shown an extension-shelf assembly which is attachable to an existing grocery store or supermarket shelf. The purpose of this assembly is to make possible a separate and prominent display of merchandise, say, an item on sale.

The assembly in accordance with the invention is constituted by a pair of clamping brackets $B_1$ and $B_2$ which are attachable at spaced positions to shelf 10 and serve to support therebetween an extension shelf formed by interlocking sections $E_1$ and $E_2$. Placed on shelf 10 are consumer items 11 of the type ordinarily stored thereon, whereas the extension shelf which projects forwardly from the shelf and is somewhat raised thereabove acts as a segregated shelf area for carrying the items to be promoted, these items having greater visibility or exposure than the usual items 11.

Figure 2:
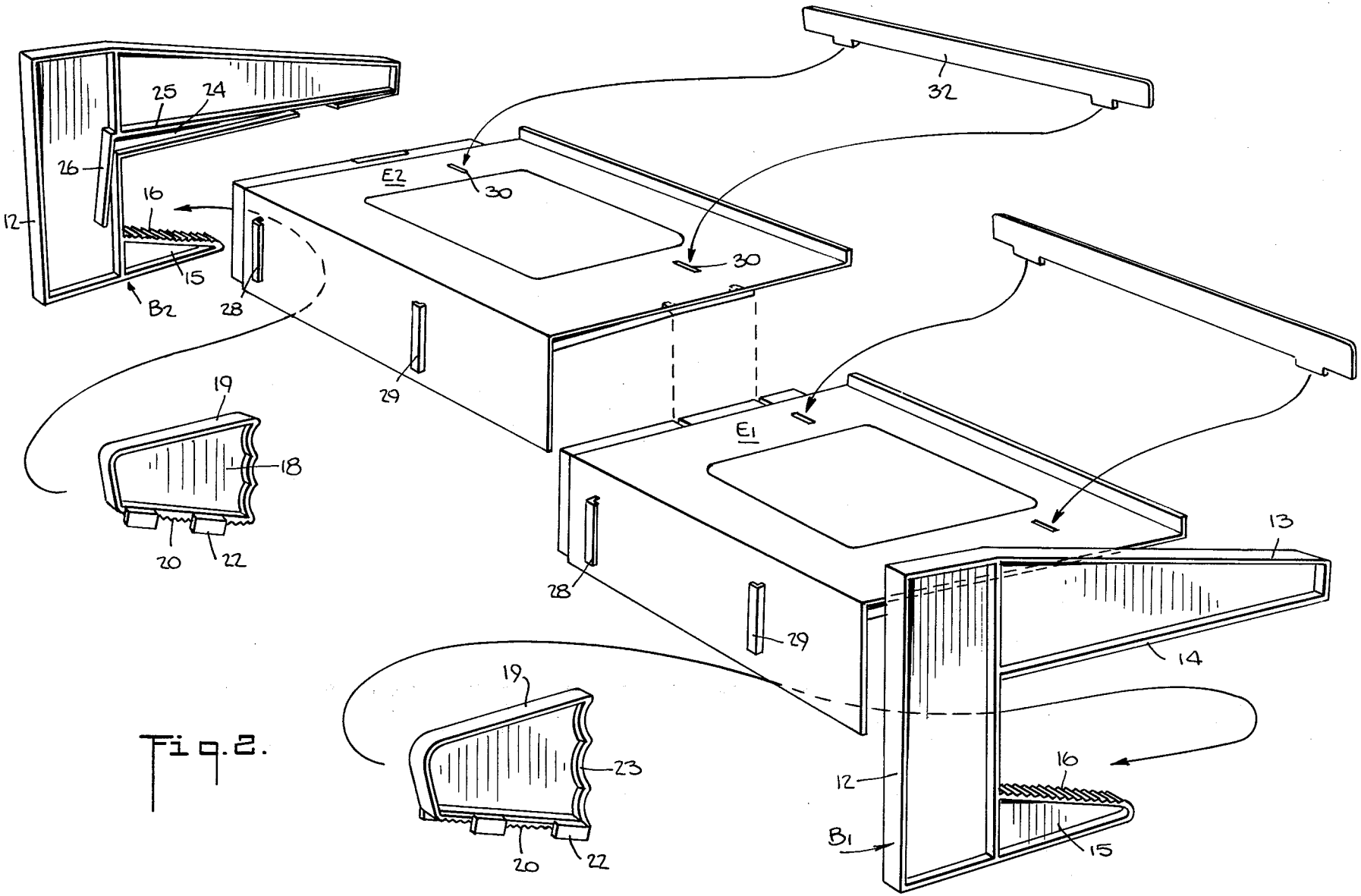
FIG. 2 is an exploded view of the shelf-extension assembly.

Each bracket ($B_1$ and $B_2$), as best seen in FIGS. 2, 3 and 4, is fabricated of molded plastic, metal or other materials of acceptable strength and is constituted by a vertical beam 12 having a framed rectangular shape, from whose upper end laterally extends a tapered upper arm 13. The lower horizontal edge of this arm is covered by a strip of flexible foam plastic material 14 which serves to resist slippage of the bracket on the shelf. Extending laterally from the lower end of beam 12 is a lower arm 15 having a ramp formation, the sloped surface 16 being treaded, preferably in a saw-tooth rack pattern.

As best seen in FIG. 3, the height of beam 12 is such that lower arm 15 extending laterally therefrom is spaced well below shelf 10 on which upper arm 13 rests, thereby defining a free space 17 which converges toward the beam. The thickness of shelf 10 determines the parameters of the free space—the thicker the shelf, the narrower the space.

As shown in dotted lines in FIG. 3, the bracket may be mounted on the shelf with the rear edge of beam 12 directly abutting the front edge of shelf 10, or it may be more or less outwardly displaced from the shelf edge to an extent limited by the ability of the associated locking piece to wedge into the free space.

Receivable into free space 17 is a wedge-shaped locking piece 18 having a horizontal upper edge 19 which engages the undersurface of shelf 10. The lower surface 20 of locking piece 18 has a threaded slope which complements the treaded surface of the ramp-shaped lower arm 15. Banking the treaded surface 20 of the locking piece on either side thereof are guide tab pairs 21 and 22, the pair of tabs on one side being staggered with respect to the tab on the other side. These tabs serve to confine the locking piece to the lower-arm ramp.

The tread on locking piece 18 is also in a saw-tooth rack pattern; hence when the locking piece is pulled or thrust into the free space 17, the locking piece rides up the ramp-shaped lower arm until it is wedged into this space. Retraction of the locking piece is resisted by the intermeshing teeth of the lower-arm tread 16 and the locking-piece tread 20. To withdraw the locking piece in order to release the bracket from the shelf, one has merely to pull the piece forcibly out of the free space.

Thus unlike conventional clamping brackets which require a tedious screwing and unscrewing action to secure and release the bracket, with the present arrangement the bracket is secured in place with a single thrusting motion and released by a single pulling action.

When the bracket is secured in place on shelf 10 or other board, it becomes difficult to displace or rotate, for the shelf is held in an alligator-like grip between the elongated upper arm and the elongated locking piece so that the surface area of the grip is quite large, as compared to that of a conventional clamping bracket.

In order to accommodate shelf-extension sections $E_1$ and $E_2$, each of the two brackets, as shown in FIG. 2 in connection with bracket $B_2$, is provided with an L-shaped socket or groove 24 defined by ridges 25 and 26. Groove 24 is adapted to receive a tongue 27 projecting from one end of shelf extension $E_2$ whose other end is connected to the adjacent end of shelf extension $E_1$. As shown separately in FIGS. 6 and 7, shelf-extensions $E_1$ and $E_2$ are interconnected by a tongue 33 and a groove 34. The other end of shelf extension $E_1$ is joined to bracket $B_1$ in a manner similar to that by which extension section $E_2$ is joined to bracket $B_2$.

The front wall of each shelf-extension, such as extension $E_2$, is provided with card holders 28 and 29 to receive a pricing card or other removable data. The top wall of each shelf-extension is provided with slots 30 and 31 to receive the feet of a divider strip 32.

Figures 1, 8:
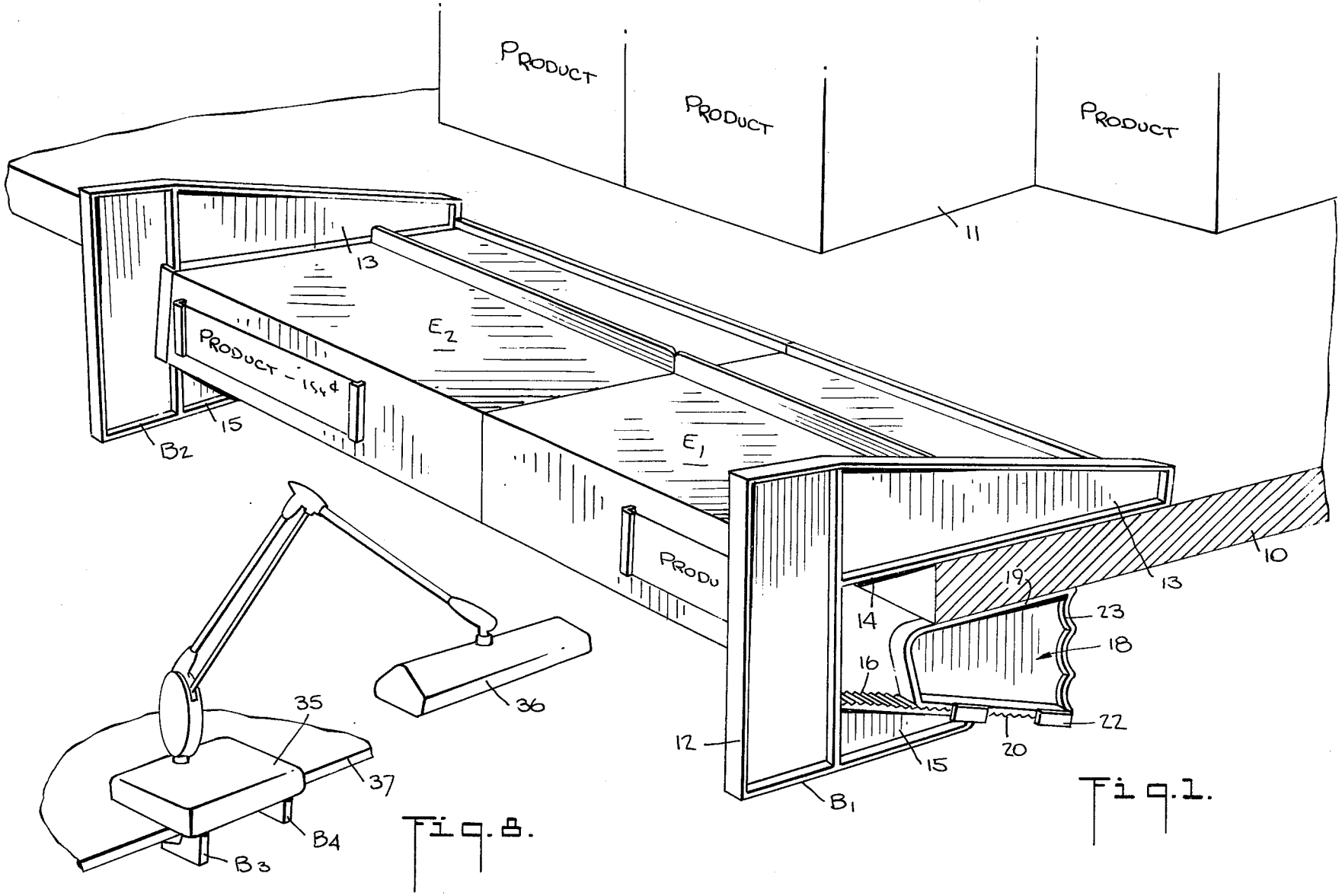
FIG. 1 is a perspective view of a shelf-extension assembly formed by a pair of clamping brackets in accordance with a preferred embodiment of the invention.
FIG. 8 is a second embodiment of the invention in which the bracket functions to secure a reading lamp to a desk lamp.

In practice, all components of the shelf-extension assembly are first joined together in the manner shown in FIG. 1, and the assembly is placed on shelf 10 at a selected position, which is then locked in place simply by inserting the locking pieces into the brackets. Removal of the shelf-extension assembly is effected simply by withdrawing the locking pieces.

Referring now to FIG. 8, brackets $B_3$ and $B_4$ are combined with the base 35 of a desk lamp 36, the brackets clamping onto a desk top 37 and being securely held thereto by means of locking pieces of the type described above. Thus instead of having to screw the lamp base onto the desk, one has only to insert the locking pieces. In practice, one may make this attachment by means of a single clamping bracket.

While there has been shown and described preferred embodiments of a clamping-type bracket in accordance with the invention, it will be appreciated that many changes and modifications may be made therein without, however, departing from the essential spirit thereof.

I claim:

1. A clamping-type bracket which is attachable without tools to a shelf or other boardlike member to support extension shelves or other objects, said bracket comprising:

A. a vertical beam whose position relative to the edge of the shelf is settable to a point abutting the edge and to points well spaced from the edge;

B. an upper arm extending laterally from the upper end of said beam, the upper arm being adapted to rest on the top surface of the shelf;

C. a lower arm extending laterally from the lower end of the beam in the same direction as said upper arm, the lower arm having a ramp formation whose sloping surface is treaded, the ramp extending below the undersurface of the shelf to define a free space converging toward the vertical beam; and D. a wedge-shaped locking piece insertable into said free space to clamp said bracket to said shelf regardless of the set position of the beam relative to the shelf edge, said piece having an upper edge which engages the undersurface of the shelf and a treaded sloping lower edge which complements the sloping surface of the ramp, whereby when said piece is inserted it rides up the ramp until it is wedged into the free space, said ramp tread being provided on either bank with guide tabs to confine the locking piece to said ramp.

2. A bracket as set forth in claim 1, wherein said upper arm is provided at its lower edge with a strip of flexible foam plastic material to resist slippage.

3. A bracket as set forth in claim 1, wherein said complementary treads each have a sawtooth rack pattern whereby the treads of the ramp and of the locking piece intermesh.

4. A bracket as set forth in claim 1, wherein the rear edge of the locking piece is scalloped to define a finger hold.

5. A bracket as set forth in claim 1, wherein said upper arm is provided with a socket to secure a shelf-extension thereto.

* * * * *